US005806450A

United States Patent [19]

Dudek et al.

[11] Patent Number: 5,806,450

[45] Date of Patent: Sep. 15, 1998

[54] METHOD AND APPARATUS FOR SEWING FABRIC PIECES TO FASTENER STRINGERS

[75] Inventors: Chet Dudek; Kiichiro Ishikawa, both of Marietta, Ga.

[73] Assignee: YKK Corporation of America, Marietta, Ga.

[21] Appl. No.: 694,219

[22] Filed: Aug. 8, 1996

[51] Int. Cl.[6] ..... D05B 35/06

[52] U.S. Cl. ..... 112/475.16; 112/152; 112/113

[58] Field of Search ..... 112/475.16, 470.21, 112/136, 147, 152, 113

[56] References Cited

U.S. PATENT DOCUMENTS

| | | | |
|---|---|---|---|
| 2,977,904 | 4/1961 | Carmen | 112/147 X |
| 4,217,840 | 8/1980 | Golembeck et al. | 112/475.16 |
| 4,274,347 | 6/1981 | Rohrer | 112/152 X |
| 4,593,635 | 6/1986 | Boser et al. | 112/475.16 |
| 4,704,781 | 11/1987 | Frohlich | 112/475.16 X |
| 5,070,799 | 12/1991 | Montgomery | 112/104 |
| 5,410,975 | 5/1995 | Dudek et al. | 112/113 |

*Primary Examiner*—Ismael Izaguirre
*Attorney, Agent, or Firm*—Hill & Simpson

[57] ABSTRACT

A method and apparatus of sewing a pair of opposed fabric pieces to a pair of continuous fastener stringers of a slide fastener; the fastener stingers having a pair of coupling elements mounted one on an opposed longitudinal edge thereof. The sewing of opposed fabric pieces to the fastener stringers is carried out at a sewing unit, while the fastener stringers are fed in disengaged disposition, with a predetermined distance kept therebetween.

14 Claims, 8 Drawing Sheets

METHOD AND APPARATUS FOR SEWING FABRIC PIECES TO FASTENER STRINGERS

BACKGROUND OF THE INVENTION

1. Field of the Invention

The present invention relates generally to a sewing machine or more particularly to an apparatus and method for folding over the opposed longitudinal edges of a pair of fabric pieces of an article and then sewing the folded longitudinal edges of the fabric pieces to a pair of continuous fastener stringers. Each continuous stringer includes a stringer tape and a row of coupling elements mounted on the longitudinal edge thereof.

2. Description of the Prior Art

Sewing methods and apparatuses of the type described above are disclosed in U.S. Pat. No. 5,410,975 and U.S. Pat. No. 5,070,799. In the prior art according to these patents, fabric pieces and fastener stringers are fed to a sewing machine, which then sews the fabric pieces and the respective fastener stringers together. Furthermore, both patent publications disclose that, as the fabric pieces pass through the folder, inner marginal edges of the opposed fabric pieces are gradually folded on themselves and the thus folded marginal edges of the fabric pieces are sewn to the respective fastener stringers in their engaged disposition.

This technique can be applied to an article wherein the folded edges of the opposed fabric pieces are disposed close to each other when the fastener element rows are coupled as indicated in FIGS. 12(*a*) and 12(*b*). However, this technique cannot be applied to an article wherein the folded edges of the opposed fabric pieces are in overlapped relation to each other (when the fastener element rows are coupled). Such an article is indicated in FIGS. 10 and 11. This is because, if sewing were carried out when the opposed fastener stringers are engaged, the overlapped fabric pieces would be sewn together.

The article shown in FIGS. 10 and 11 is advantageous in that the folded edge of one of the opposed fabric pieces projects far beyond the folded edge of the other fabric piece, when the opposed coupling element rows are coupled, thus concealing the coupling element rows and the stringer tapes. This causes the article to look different from the article in which coupled element rows are exposed between the folded edges of fabric pieces (FIG. 12(*a*)) and the article in which part of the stringer tape is exposed therebetween (FIG. 12(*b*)).

Therefore, the sewing technique has been long desired which can be applied to an article wherein the folded edges of the opposed fabric pieces are in overlapped relation to each other.

SUMMARY OF THE INVENTION

With the foregoing difficulties in view, it is therefore an object of the present invention to provide a method and an apparatus for sewing fabric pieces to a pair of continuous fastener stringers in such a manner that the fabric pieces can conceal the fastener element rows and fastener tapes of the fastener stringers from the external view, the method being simple and easy.

According to one aspect of the present invention, there is provided a method of sewing a pair of opposed fabric pieces to a pair of continuous fastener stringers of a slide fastener; the continuous fastener stingers including a pair of elongate stringer tapes, and two rows of coupling elements mounted one on an opposed longitudinal edge of each stringer tape the method comprising the steps of: bringing opposed coupling element rows out of engagement with each other to thus separate the fastener stringers by a predetermined distance; feeding the thus separated stringers to a sewing unit with the predetermined distance kept therebetween; folding marginal edges of the opposed fabric pieces and feeding the opposed fabric pieces to the sewing unit; and sewing the separated fastener stringers to the respective opposed fabric pieces.

In the method, the folding of the marginal edges of the opposed fabric pieces is carried out gradually in a folder.

In the method, the folded marginal edge of one fabric piece projects beyond the coupling element row of the respective fastener stringer.

In the method, after the sewing step, the disengaged fastener element rows of the fastener stringers sewn to the respective fabric pieces are again brought into engagement with each other and withdrawn.

According to another aspect of the present invention, there is provided an apparatus for sewing a pair of opposed fabric pieces to a pair of continuous fastener stringers of a slide fastener; the continues fastener stringers including a pair of elongate stringer tapes and two rows of coupling elements mounted one on an opposed longitudinal edge of each fastener stringer; the apparatus comprising: separating means for bringing coupling elements rows out of coupling engagement with each other, thus separating the continuous fastener stringers; a fabric folder disposed over the separating means for folding marginal edges of the opposed fabric pieces; a sewing unit disposed downstream of the separating means for sewing the continuous fastener stringers to the respective opposed fabric pieces; and a drive means for dragging the slide fastener stringers downstream.

The apparatus may further include an engaging means disposed downstream of the sewing unit for bringing the disengaged coupling element rows into coupling engagement with each other.

The apparatus may further include a guide means, disposed between the sewing unit and the engaging means, for guiding the fastener stringers with the distance therebetween kept constant.

In the apparatus, the fabric folder includes a pair of folder members each including a flat portion and a U-shaped inner edge merged from the flat portion, the U-shaped inner edge being gradually bent more and more inwardly from the flat portion as it goes downstream.

The apparatus may further include a pressure unit mounted over the fabric folder for depressing the fabric pieces against the flat portion of the fabric folder.

The apparatus may further include a drive unit for feeding the fabric pieces and the respective fastener stringers sewn together downstream.

In the apparatus, the upstream side of the engaging means is tapered upstream.

In the apparatus, the upstream side of the guide means is tapered upstream.

In the apparatus, the opposed folder members can be adjusted in distance therebetween.

In an apparatus, each U-shaped inner edge is tapered toward the downstream end of the fabric folder.

Many other advantages and features of the present invention will become manifest to those versed in the art upon making reference to the detailed description and the accompanying sheets of drawings in which preferred structural embodiments incorporating the principles of the present invention are shown by way of illustrated example.

BRIEF DESCRIPTION OF THE DRAWINGS

FIG. 12(*b*) is a fragmentary plan view of another example of a pair of fabric pieces and the respective fastener stringers sewn together by a conventional device.

DETAILED DESCRIPTION

Figure 1:
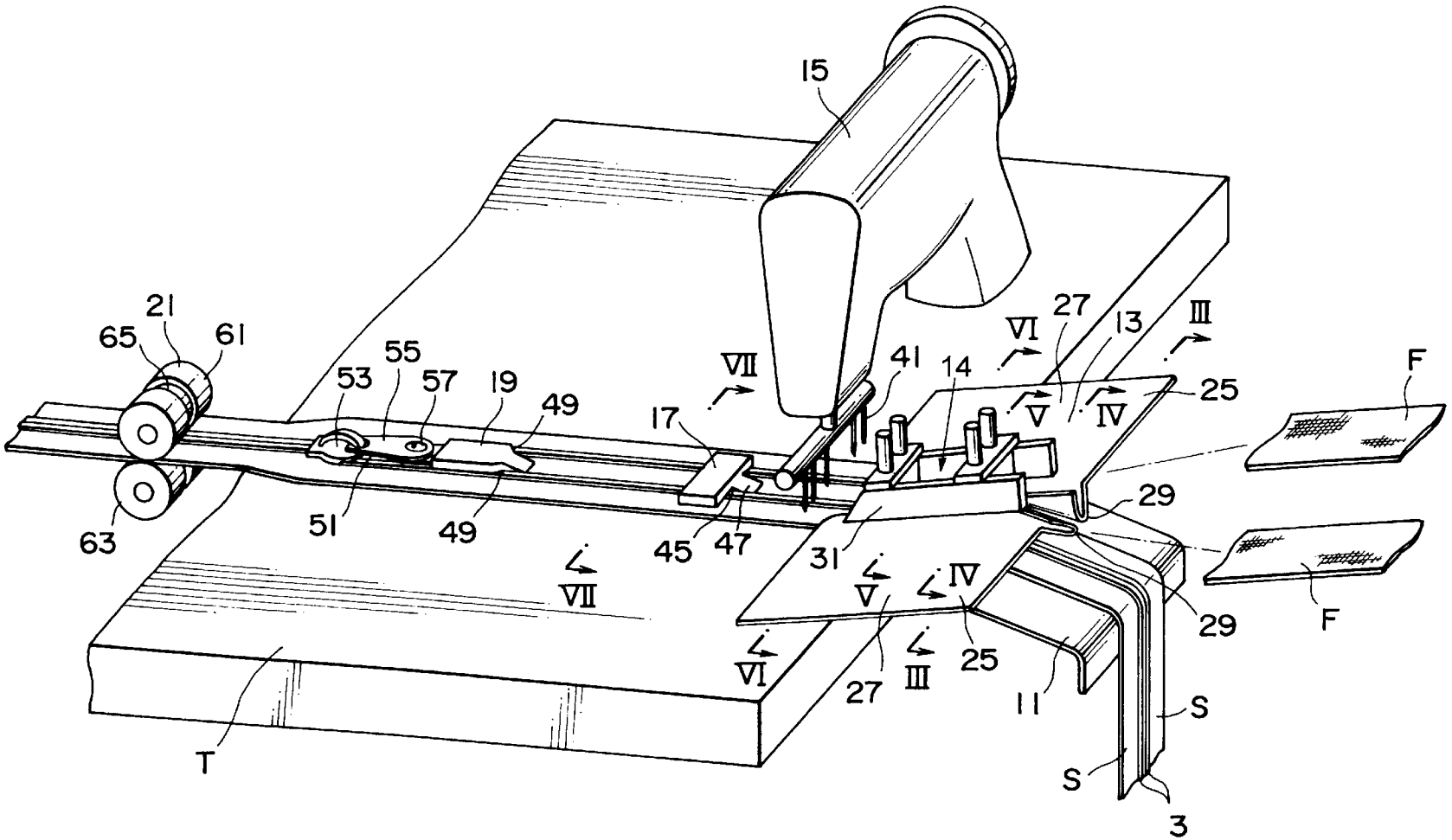
FIG. 1 is an overall view of an apparatus according to the present invention.

FIG. 1 shows an overall view of an apparatus according to this invention.

Before proceeding to the description of the method and apparatus according to the present invention, a pair of continuous fastener stringers S, S and a pair of fabric pieces F, F which will undergo the method and apparatus will be described. The continuous two engaged stringers are also called a fastener chain as a whole in this art. Each fastener stringer S is comprised of a fastener tape 1 and a row of coupling fastener elements 3, 3 mounted on a longitudinal edge thereof. The fabric pieces F, F are part of clothing or a baggage that defines an opening and to which fastener stringers S, S are to be sewn.

There are various units mounted on a work table T. From the upstream side to downstream side (from the right side to the left side as viewed in FIGS. 1 and 2), a fastener stringer guide plate 11, a separating unit or separator block 12, a fabric folder 13, and pressure unit 14, a sewing unit or station 15, a guide unit or guide block 17, a closing unit or engaging block 19 and a drive unit 21 are arranged in the above-mentioned order.

The fabric folder 13 and the fastener stringer guide plate 11 are mounted on the upstream end of a work table T with their respective upstream ends projecting beyond the edge of the work table T.

Figure 3:
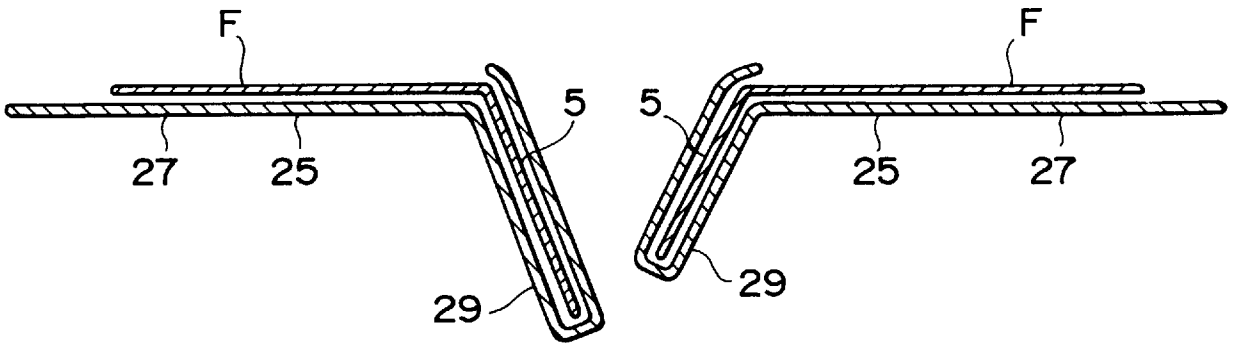
FIG. 3 is a cross-sectional view taken on line III—III of FIG. 1.
Figure 4:
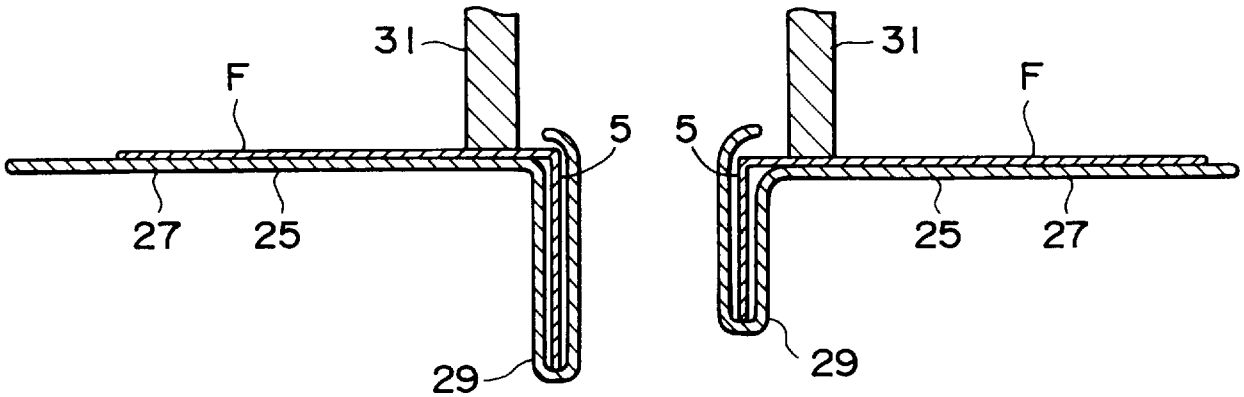
FIG. 4 is a cross-sectional view taken on line IV—IV of FIG. 1.
Figure 5:
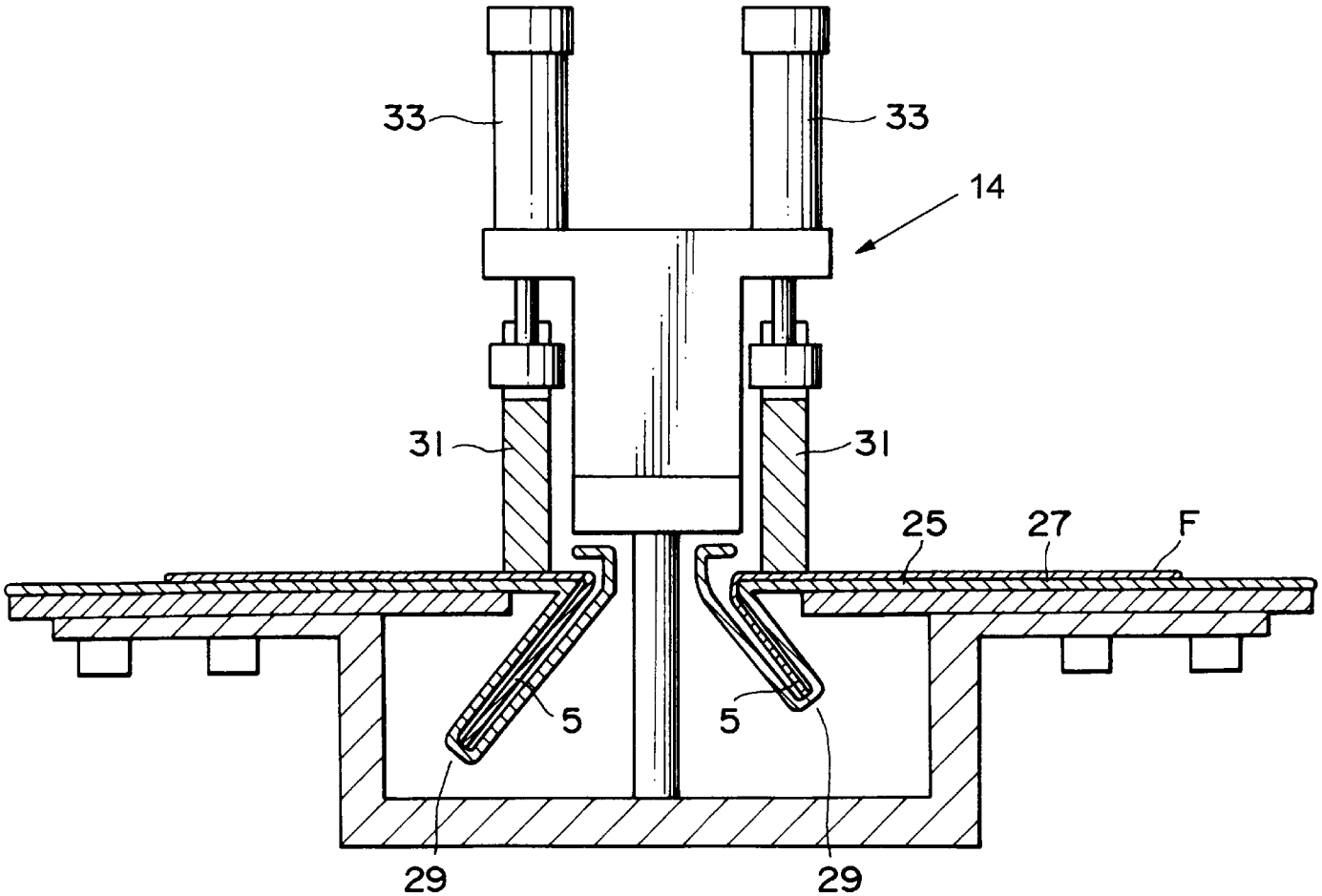
FIG. 5 is a cross-sectional view taken on line V—V of FIG. 1.
Figure 6:
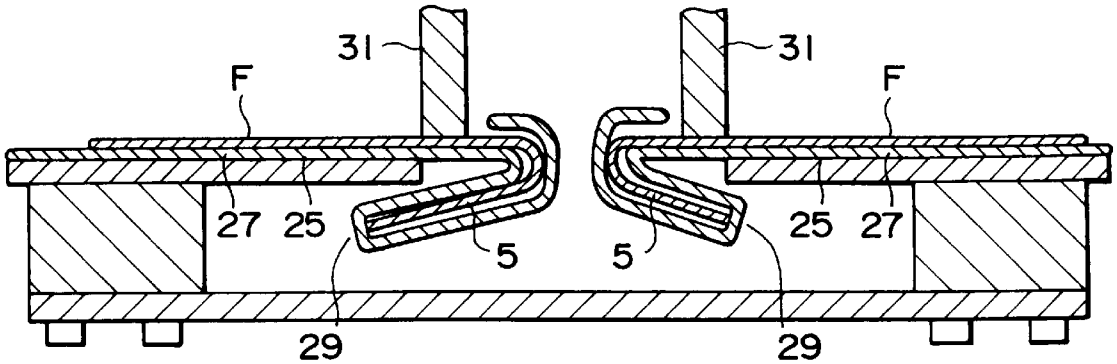
FIG. 6 is a cross-sectional view taken on line VI—VI of FIG. 1.
Figure 7:
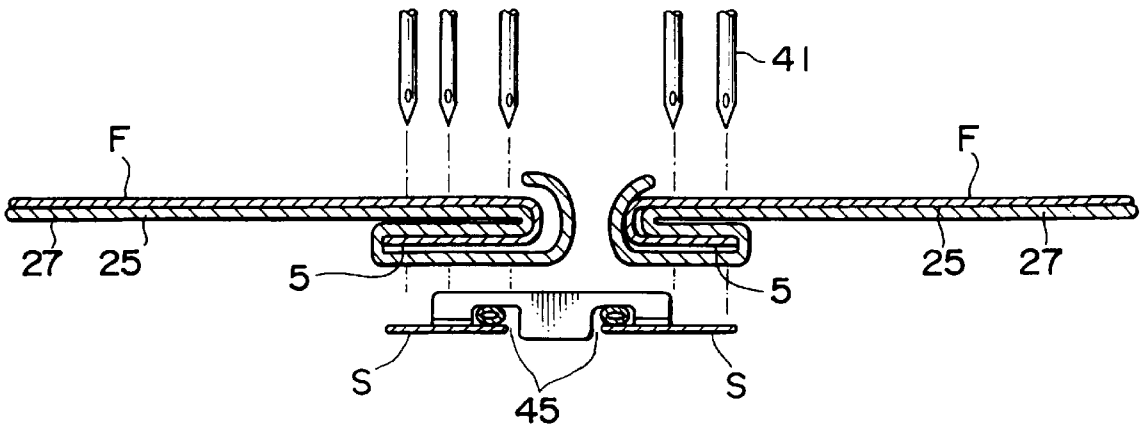
FIG. 7 is a cross-sectional view taken on line VII—VII of FIG. 1.
Figure 8:
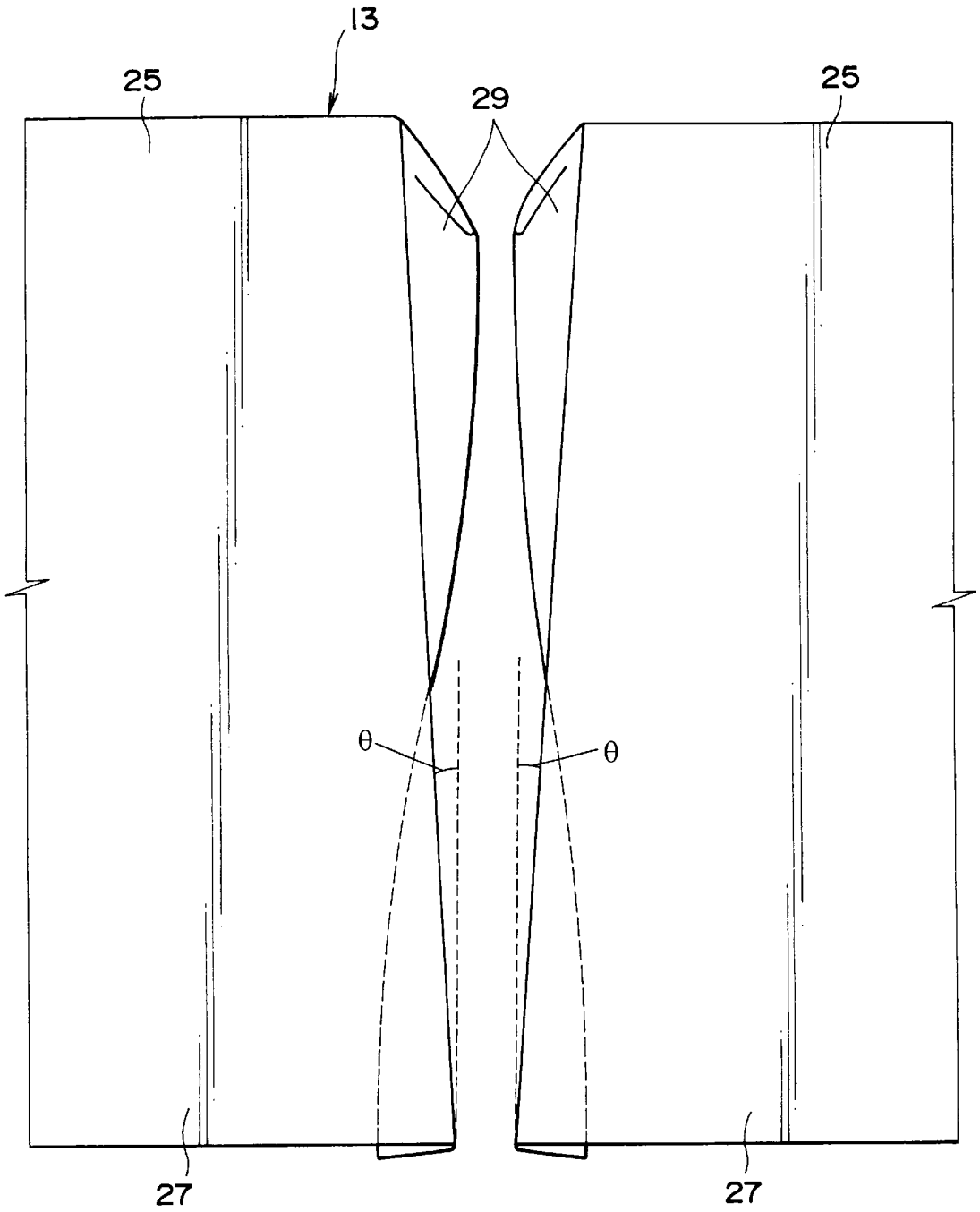
FIG. 8 is a plan view of a fabric folder of the apparatus of FIG. 1.
Figure 9:
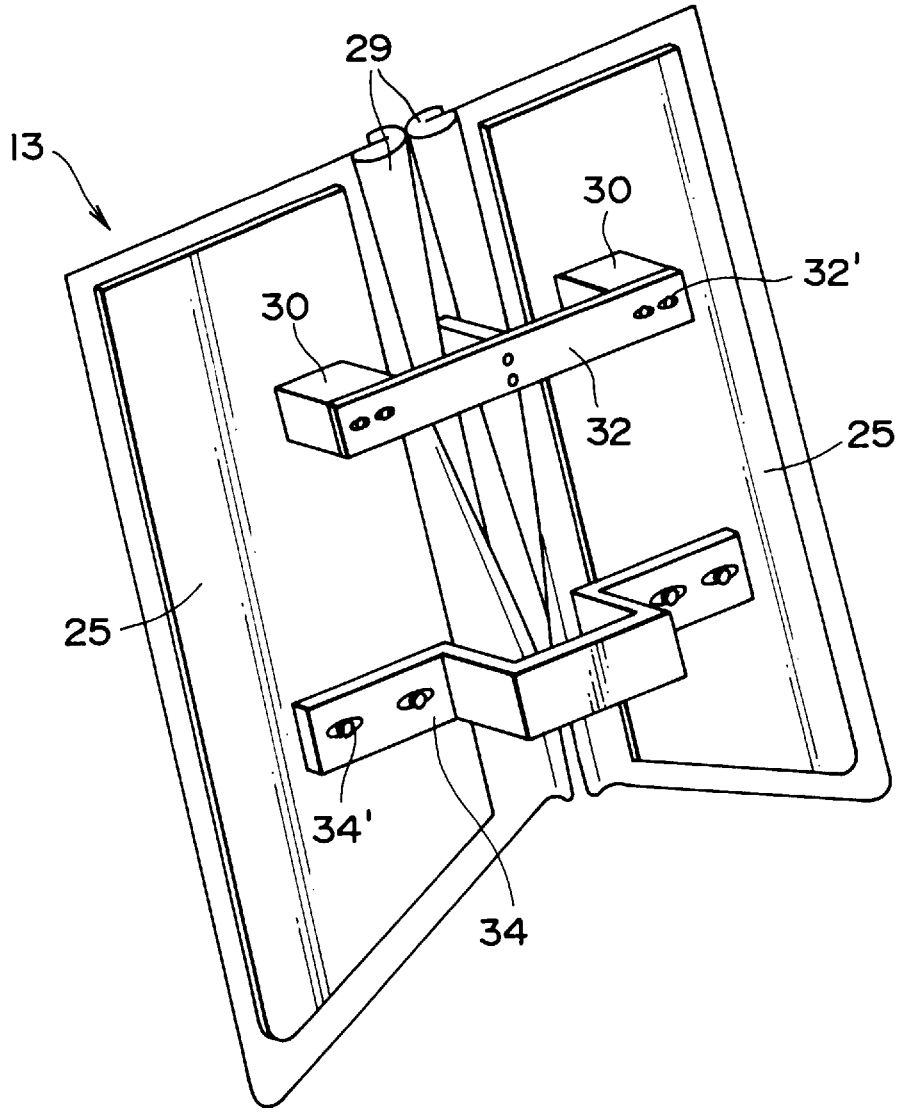
FIG. 9 is a perspective view of the fabric folder as viewed from below.

As better shown in FIGS. 8 and 9, the fabric folder 13 includes a pair of folder members 25, 25 each including a major flat portion 27 and a U-shaped inner edge 29 merged from the flat portion 27. The pair of right and left folder members 25, 25 are symmetrical to each other across the central axis of the fabric folder 13, except that one of the U-shaped inner edges 29 is slightly greater in width than the other U-shaped inner edge 29, as best shown in FIG. 4. Each U-shaped inner edge 29, 29 tapers or gradually decreases in width from the upstream end towards the downstream end of the fabric folder 13, for the reason closely set forth hereinbelow. As illustrated in FIG. 8, the facing edges of folder members 25 are mounted at an angle θ of about, for example, four degrees relative to the sew line. Furthermore, as shown in FIGS. 3 through 7, the U-shaped inner edge 29, 29 of each folder member 25, 25 is gradually bent more and more inwardly from the major flat portion 27, 27, as it goes downstream until the U-shaped inner edge 29, 29 is completely folded beneath the major flat portion 27, 27 at the downstream end of the fabric folder 13. More specifically, the U-shaped inner edge 29, 29 is bent at an obtuse angle relative to the major flat portion 27, 27 at the upstream end of the of fabric folder 25, 25 as shown in FIG. 3. Then, the inner edge 29, 29 is bent at a right angle relative to the major flat portion 27, 27 before the pressure unit, as shown in FIG. 4. Then, the inner edge 29, 29 is bent at an acute angle relative to the major flat portion 27, 27 under the pressure unit as shown in FIG. 5. Then, the inner edge 29, 29 is at a further acute angle relative to the major flat portion 27, 27 at the downward end of the pressure unit, as shown in FIG. 6. Eventually, the inner edge 29, 29 is completely folded back at 180 degrees on the major flat portion 27, 27.

Figure 11:
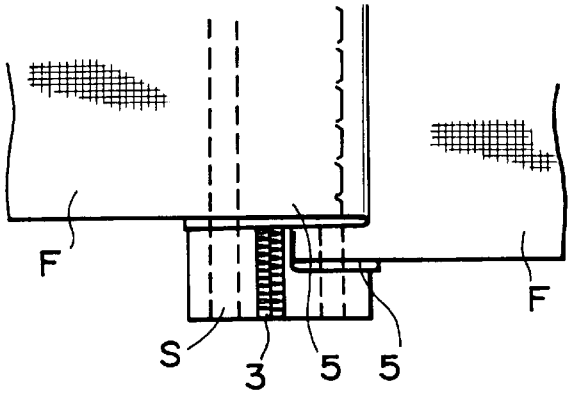
FIG. 11 is a view similar to FIG. 10, but with the fastener stringers coupled.
Figure 12A:
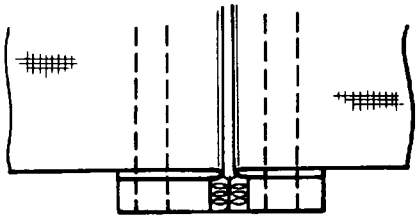
FIG. 12(*a*) is a fragmentary plan view of one example of a pair of fabric pieces and the respective fastener stringers sewn together by a conventional device.
Figure 12B:
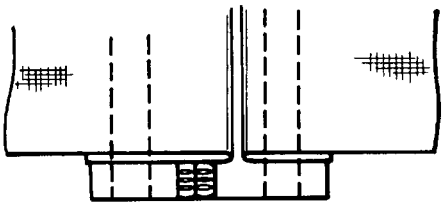

As better shown in FIG. 9, in addition, the fabric folder 13 includes a pair of blocks 30, 30 mounted on the lower sides of the respective folder members 25, 25 adjacent to the downstream end of the fabric folder 13 and a link plate 32 for connecting the blocks 30, 30. The link plate 32 has a plurality of slots 32' formed therethrough and separated along its length. The link plate 32 is connected adjacent its opposed ends to the blocks 30, 30 by fastening bolts through the slots 32' of the link plate 32 to the blocks 30, 30. The fabric folder 13 also includes a channel-shaped connecting plate 34. Similarly, the opposed end portions of the connecting plate 34 have a plurality of slots 34' formed therethrough and separated along its length. The channel-shaped connecting plate 34 is connected adjacent the oposed ends with lower sides of the folder members 25, 25 adjacent to the upstream end of the fabric folder 13. Due to the bolt-slot-connecting arrangement, the opposed folder members 25, 25 can be adjusted in distance therebetween. Consequently, the two opposed fabric pieces F, F can be sewn to the fastener stringers S, S with various desired distances left between the fabric pieces F, F. This permits the apparatus of the invention to sew various types of seams as illustrated in FIGS. 11, 12*a* and 12*b*.

As shown in FIG. 5, the pressure unit 14 is mounted above the inner U-shaped edges 29, 29 of the fabric folder members 25, 25 of the fabric folder 13. The pressure unit 14 is comprised of two presser plates 31, 31 which are reciprocally movable by a suitable drive means 33 such as a fluid-pressure actuator between an elevated position and an depressed position. The presser plates 31, 31 are adapted to press the opposed fabric pieces F, F' against the flat portions 27, 27 of the fabric folder 13, as shown in FIGS. 4 and 5. The advantage is that, with the use of the pressure unit, an operator need not hold the fabric pieces against the flat portions 27, 27 of the fabric folder 13 with his hands.

Figure 2:
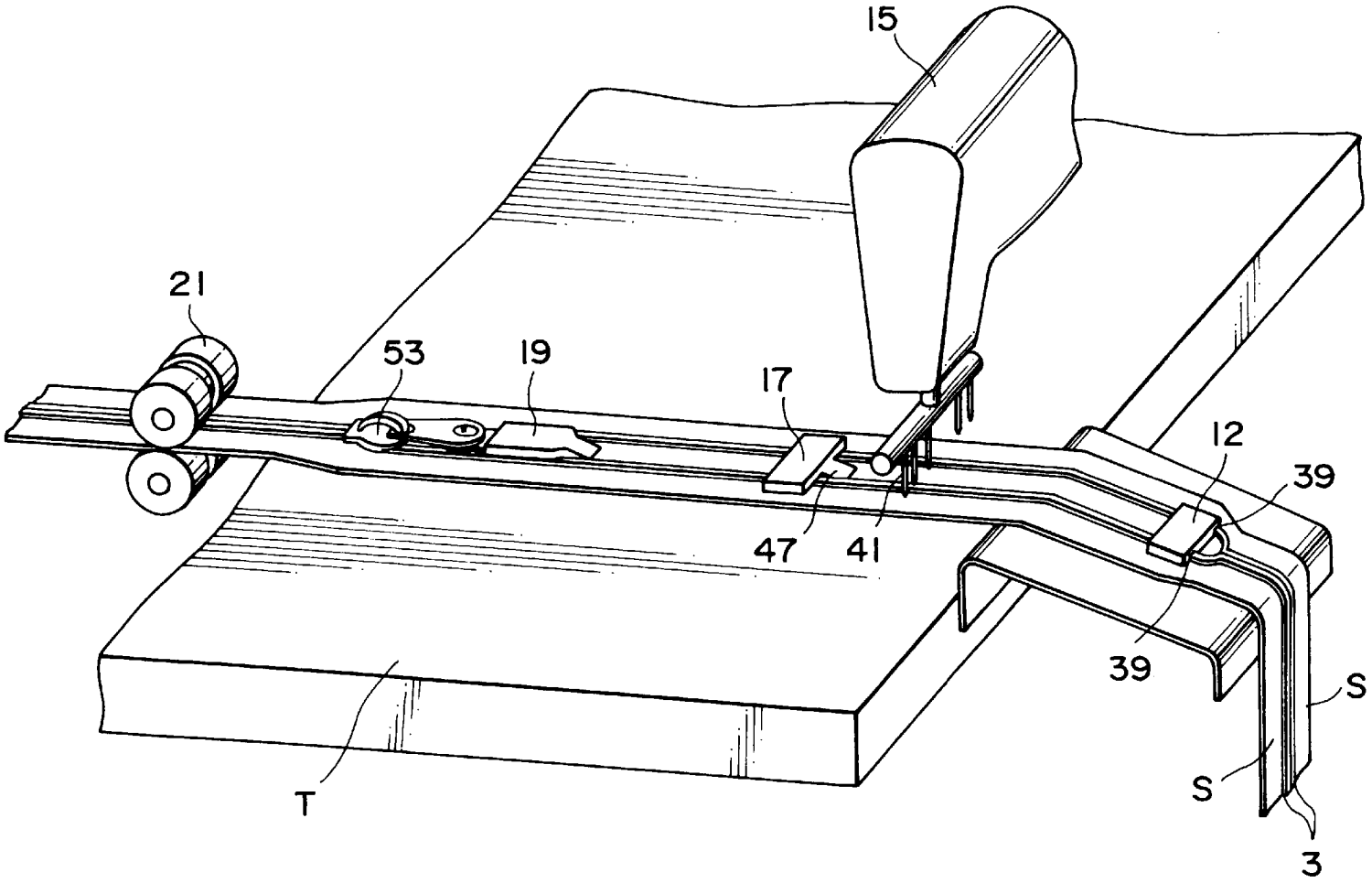
FIG. 2 is a view similar to FIG. 1, but a folder and a pressure unit omitted.

As shown in FIGS. 1 and 2, the slide fastener guide plate 11 is disposed under the fabric folder 13. The fabric folder 13 is slanted downward, while the slide fastener guide plate 11 is slanted upwards in the downstream direction so that the fabric folder 13 and the slide fastener guide plate 11 are converged towards sewing needles 41 of the sewing station 15. The slide fastener guide plate 11 has a separating block 12 mounted on the upper surface in the middle thereof. The separating block 12 has a pair of parallel guide channels 39, 39 formed therethrough. The separating block 12 is intended for bringing out of coupled engagement a pair of coupled fastener element rows 3, 3, of fastener stringers S, S unwound or discharged from a bobbin (not shown) disposed below the slide fastener guide plate 11 and for separating the fastener stringers S, S at a predetermined distance. The upstream end of the slide fastener stringer guide plate 11 is bent downward so that the fastener stringers S, S flow to the separator block 12 through the downward-bent end of the guide plate 11.

The sewing unit 15 is mounted immediately downstream of the fabric folder 13. The sewing unit 15 is adapted to sew opposed folded longitudinal edges 5, 5 of the respective fabric pieces F, F to a pair of fastener stringers S, S. To this end, the sewing unit 15 includes five laterally spaced sewing needles 41. As well shown in FIG. 7, the five needles 41 are arranged such that out of the five needles 41 three needles 41 sew the longer folded edge 5 and the remaining two needles 41 sew the shorter folded edge 5 to the respective fastener stringers S, S. The sewing unit 15 is driven by an electric motor (not shown) which can be started and stopped in response to activation and de-activation of a foot switch (not shown). In addition,sewing may generally be stopped when the end of a panel being sewn is detected by a sensor. The construction and function of the sewing unit 15 is known per se and, therefore, any further detailed description of the sewing unit 15 will be omitted here.

As shown in FIG. 1, the guide block 17 is mounted on the work table T immediately downstream of the sewing unit 15. The guide block 17 has a pair of guide channels 45, 45 formed therethrough. The opposed disengaged fastener element rows 3, 3 are guided through the guide channels 45, 45 with a constant distance kept therebetween. The upstream side 47 of the guide block 17 is tapered upstream so as to prevent the fabric pieces F, F sewn to the disengaged fastener stringers S, S from getting jammed into the channels 45, 45 as the disengaged element rows 3, 3 are guided through the channels 45, 45.

As shown in FIG. 1, the engaging block 19 is mounted on the work table T further downstream of the guide block 17. The engaging block 19 has a pair of guide channels 49, 49 formed therethrough and adapted to guide the opposed disengaged fastener element rows 3, 3 therethrough. The upstream side of the engaging block 19 is tapered upstream so as to prevent the fabric pieces F, F from getting jammed into the channels 49, 49 as the disengaged element rows 3, 3 are guided through the channels 49, 49. The engaging block 19 has a slider-holding part 51 provided on the downstream end thereof. A slider 53 is secured to the slider holding part 51, by fastening a pull tab 55 of the slider 53 to the slider holding part 51 by fastening means 57 such as a screw, with the flared front end of the slider 53 oriented upstream, so that, as the disengaged element rows 3, 3 are guided through the engaging block 19 and through the slider 53, the disengaged element rows 3, 3 are brought into coupling engagement with each other.

The drive unit 21 is mounted on the work table T downstream of the engaging block 19. The drive unit 21 is comprised of a pair of drive and follower rollers 61, 63 rotatably mounted on parallel axes and in close contact with each other, with the engaged fastener stringers S, S and fabric pieces F, F sewn thereto interposed therebetween. The drive roller 61 is driven by suitable drive means (not shown) such as an electric motor, one way clutch or variable speed cloth puller, so that the drive unit 21 can drag the engaged fastener stringers S, S and fabric pieces F, F sewn thereto downstream. Each roller 61, 63 has a peripheral groove 65 formed circumferentially in the middle thereof to accommodate engaged fastener element rows 3, 3 therein.

With the construction of the apparatus set forth above, the function of the apparatus is set forth below.

As shown in FIG. 1, the continuous fastener stringers S, S in engaged disposition unwrapped from the bobbin (not shown) are fed to the slanted fastener stringer guide plate 11. As better shown in FIG. 2, the engaged fastener element rows. 3, 3 are brought out of engagement with each other by the separating unit 12 so that the fastener stringers S, S are separated from each other by a predetermined distance. The disengaged fastener stringers S, S are fed to the sewing unit 15 with a predetermined distance kept constant.

As shown in FIG. 1, a pair of fabric pieces F, F are placed on the fabric folder members 25, 25 with their inner opposed edges 5, 5 inserted into the U-shaped inner edges 29, 29 of the fabric folder members 25, 25. The fabric pieces F, F are sewn at the sewing unit just immediately downstream of the downstream end of the fabric folder 13. Therefore, where the needles run is governed by the width of the U-shaped edge 29 measured at the downstream end of the fabric folder 13. If the U-shaped edge 29 were uniform in width throughout the entire length of the fabric folder 13, it would be very difficult to sew the fabric pieces F, F at their proper positions; since, as the fabric pieces F, F move downstream on the folder members 25, 25, the longitudinal edges 5, 5 of the fabric pieces F, F are gradually pushed out of the respective U-shaped edges 29, 29 due to frictional resistance between the inner surfaces of the U-shaped edges 29, 29 and the inner edges 5, 5 of the fabric pieces F, F. According to this invention, since the U-shaped edges 29, 29 of the fabric folder 13 taper downstream; the fabric folder 13 can receive in the corresponding U-shaped edges 29 fabric pieces F, F which are greater in width at the upstream end of the fabric folder 13 than those at the downstream end thereof. Consequently, the fabric pieces F, F can be sewn at their proper positions, even if the fabric pieces F, F are gradually pushed out of the corresponding U-shaped edges 29, 29 due to the frictional resistance as being fed downstream.

Then, the pressure plates 31, 31 are activated to move downwards to depress the respective fabric pieces F, F against the major flat portions 27, 27 of the fabric folder members 25, 25 adjacent to the U-shaped inner edge portions 27, 27. The fabric pieces F, F, while being depressed by the pressure plates 31, 31, are slid against the major flat portions 27, 27 of the fabric folder members 25, 25 downstream, so that the fabric pieces F, F move to the sewing unit 15. Due to the gradual folding of the U-shaped inner edges 29, 29 of the folder, as the fabric pieces F, F move downstream, the opposed inner longitudinal edges 5, 5 of the fabric pieces F, F are gradually folded until reaching the downstream end of the folder 13 whereupon they are completely folded on the respective fabric pieces F, F, as better shown in FIG. 7.

The folded edges 5, 5 of the fabric pieces F, F and the separated fastener stringers S, S are placed in overlapped relation to each other immediately before they reach the sewing unit 15.

As shown in FIG. 7, the inner folded portions 5, 5 of the fabric pieces F, F are slightly deviated (rightward as viewed in FIG. 7) relative to the disengaged fastener stringers S, S.

Figure 10:
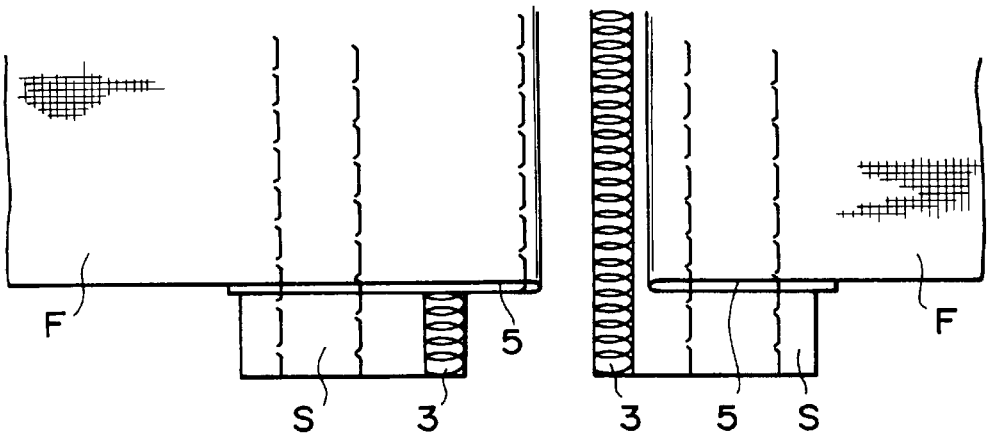
FIG. 10 is a fragmentary plan view of a pair of fabric pieces and the respective fastener stringers sewn together by the apparatus shown in FIG. 1, with the fastener stringers remaining uncoupled.

The reciprocal vertical movement of the sewing needles 41 of the sewing unit 15 causes the opposed folded edges 5, 5 of the fabric pieces F, F to be sewn to the disengaged fastener stringers S, S as shown in FIG. 10. The folded edge 5 of one fabric piece F (left fabric piece in FIG. 10) projects beyond the corresponding fastener element row 3, while that of the other fabric piece F' (right fabric piece) terminates short of the corresponding fastener element row 3.

After the fabric pieces F, F and the fasteners stringers S, S are sewn together, they are fed through the guide block 17 and the engaging block 19. As the fastener element rows 3, 3 of the separated fastener stringers S, S are guided through the guide channel 49, 49 of the engaging block 19 and the Y-shaped guide channel of the slider 53, the fastener element rows 3, 3 are brought into engagement with each other so that the fastener stringers S, S with the fabric pieces F, F sewn thereto are engaged or closed. The finished product, that is, the continuous fastener stringers S, S with the fabric pieces F, F sewn thereto is withdrawn from this apparatus and proceed to another step, or stock or to shipment.

The method and apparatus set forth above result in the following advantages: as well as other advantages.

Finished articles such as clothing or baggage can be produced where fabric pieces completely conceal the fastener element rows and fastener tapes, so that the aesthetic quality of the finished articles has been highly enhanced.

If fastener stringers are fed to and discharged from the apparatus in engaged disposition, the stock administration is easy. The apparatus allows the user to sew various types of seams, as illustrated in FIG. 11 and also FIGS. 12*a* and 12*b*.

Obviously, various modifications and variations of the present invention are possible in the light of the above teaching. It is therefore to be understood that within the scope of the appended claims, the invention may be practiced otherwise than as specifically described.

What is claimed is:

1. A method of sewing a pair of opposed fabric pieces to a pair of continuous fastener stringers of a slide fastener; the continuous fastener stringers including a pair of elongate stringer tapes and two rows of coupling elements mounted one on an opposed longitudinal edge of each stringer tape, the method comprising the steps of:

feeding the pair of fastener stringers to a sewing apparatus with the coupling elements engaged;

bringing the engaged opposed coupling element rows out of engagement with each other via a separating means carried by the sewing apparatus to thus separate the fastener stringers by a predetermined distance;

feeding the thus separated stringers to a sewing unit of the sewing apparatus with the predetermined distance kept therebetween;

folding marginal edges of the opposed fabric pieces via a fabric folder;

feeding the opposed fabric pieces to the sewing unit; and sewing the separated fastener stringers to the respective opposed fabric pieces.

2. A method according to claim 1, wherein the folding of the marginal edges of the opposed fabric pieces is carried out gradually in the folder.

3. A method according to claim 1, wherein during folding the folded marginal edge of one fabric piece is projected beyond the coupling element row of the respective fastener stringer.

4. A method according to claim 1, wherein after the sewing step, the disengaged fastener element rows of the fastener stringers sewn to the respective fabric pieces are again brought into engagement with each other and withdrawn.

5. An apparatus for sewing a pair of opposed fabric pieces to a pair of continuous fastener stringers of a slide fastener; the continuous fastener stringers including a pair of elongate stringer tapes and two rows of coupling elements mounted one on an opposed longitudinal edge of each fastener stringer; the apparatus comprising:

a separating means for bringing the coupling element rows out of coupling engagement with each other, thus separating the continuous fastener stringers;

a fabric folder disposed over the separating means for folding marginal edges of the opposed fabric pieces;

a sewing unit disposed downstream of the separating means for sewing the continuous fastener stringers to the respective opposed fabric pieces; and a drive means for dragging the slide fastener stringers downstream.

6. An apparatus according to claim 5, further including a drive unit for feeding the fabric pieces and the respective fastener stringers sewn together downstream.

7. An apparatus according to claim 5, further including engaging means disposed downstream of the sewing unit for bringing the disengaged coupling element rows into coupling engagement with each other.

8. An apparatus according to claim 7, the upstream side of the engaging means being tapered upstream.

9. An apparatus according to claim 5, further including a guide means, disposed between the sewing unit and the engaging means for guiding the fastener stringers with the distance therebetween kept constant.

10. An apparatus according to claim 9, the upstream side of the guide means being tapered upstream.

11. An apparatus according to claim 5, the fabric folder includes a pair of folder members each including a flat portion and a U-shaped inner edge merged from the flat portion, the U-shaped inner edge being gradually bent more and more inwardly from the flat portion as it goes downstream.

12. An apparatus according to claim 11, further including a pressure unit mounted over the fabric folder for depressing the fabric pieces against the flat portion of the fabric folder.

13. An apparatus according to claim 8 wherein the opposed folder members can be adjusted in distance therebetween.

14. An apparatus according to claim 8 wherein each U-shaped inner edge is tapered toward the downstream end of the fabric folder.

* * * * *